United States Patent [19]

de la Sota Martinez

[11] Patent Number: 4,525,009

[45] Date of Patent: Jun. 25, 1985

[54] CHAIR CHANGEABLE INTO EASY CHAIR

[76] Inventor: Alejandro de la Sota Martinez, Avenida de América No. 49, Madrid-2, Spain

[21] Appl. No.: 461,973

[22] Filed: Jan. 26, 1983

[30] Foreign Application Priority Data

Jan. 29, 1982 [ES] Spain ..... 262.857[U]

[51] Int. Cl.[3] ..... A47C 13/00

[52] U.S. Cl. ..... 297/118; 297/357; 297/438

[58] Field of Search ..... 297/357, 438, 429, 353, 297/118, 440, 449

[56] References Cited

U.S. PATENT DOCUMENTS

| | | | |
|---|---|---|---|
| 1,440,329 | 12/1922 | Aime | 297/438 X |
| 1,947,410 | 2/1934 | Emerson | 297/357 X |
| 2,089,867 | 8/1937 | Welch | 297/357 |
| 2,120,183 | 6/1938 | Mearkle | 297/357 X |
| 2,403,263 | 7/1946 | Collins | 297/438 X |
| 2,486,716 | 11/1949 | Kuebler | 297/357 |
| 2,561,886 | 7/1951 | Rikelman | 297/357 |
| 3,640,576 | 2/1972 | Morrison et al. | 297/445 X |

FOREIGN PATENT DOCUMENTS

| | | | |
|---|---|---|---|
| 1115933 | 1/1956 | France | 297/357 |

*Primary Examiner*—James T. McCall

*Attorney, Agent, or Firm*—Wenderoth, Lind & Ponack

[57] ABSTRACT

An article of furniture is convertible between first and second positions of use as a chair and as a lounge, respectively. A base structure includes two generally U-shaped frameworks each having first and second legs. The frameworks are connected together in spaced parallel planes by a rod connecting the first legs and by a rigid panel extending between and connecting the second legs. The base structure is movable between a first position of use whereat the rigid panel is a seat of the chair and the first legs form one support of the chair, and a second position of use, whereat the first and second legs form two supports of the lounge. A first U-shaped frame has arms pivotally mounted to respective frameworks about a first axis about which the first frame is rotatable between a first position, whereat the first frame forms another support of the chair, and a second position, whereat the first frame forms a seat of the lounge. A second U-shaped frame has arms pivotally mounted to respective frameworks about a second axis about which the second frame is movable between a first position, whereat the second frame forms a backrest of the chair, and a second position, whereat the second frame forms a backrest of the lounge.

8 Claims, 10 Drawing Figures

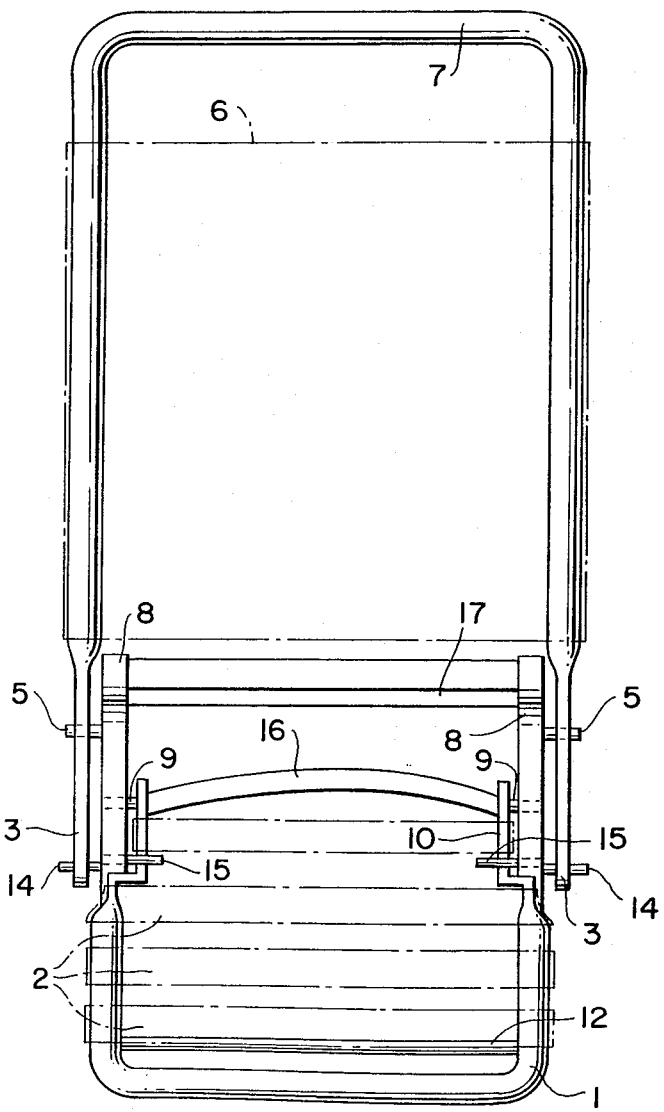
FIG. 1.
FIG. 1A.
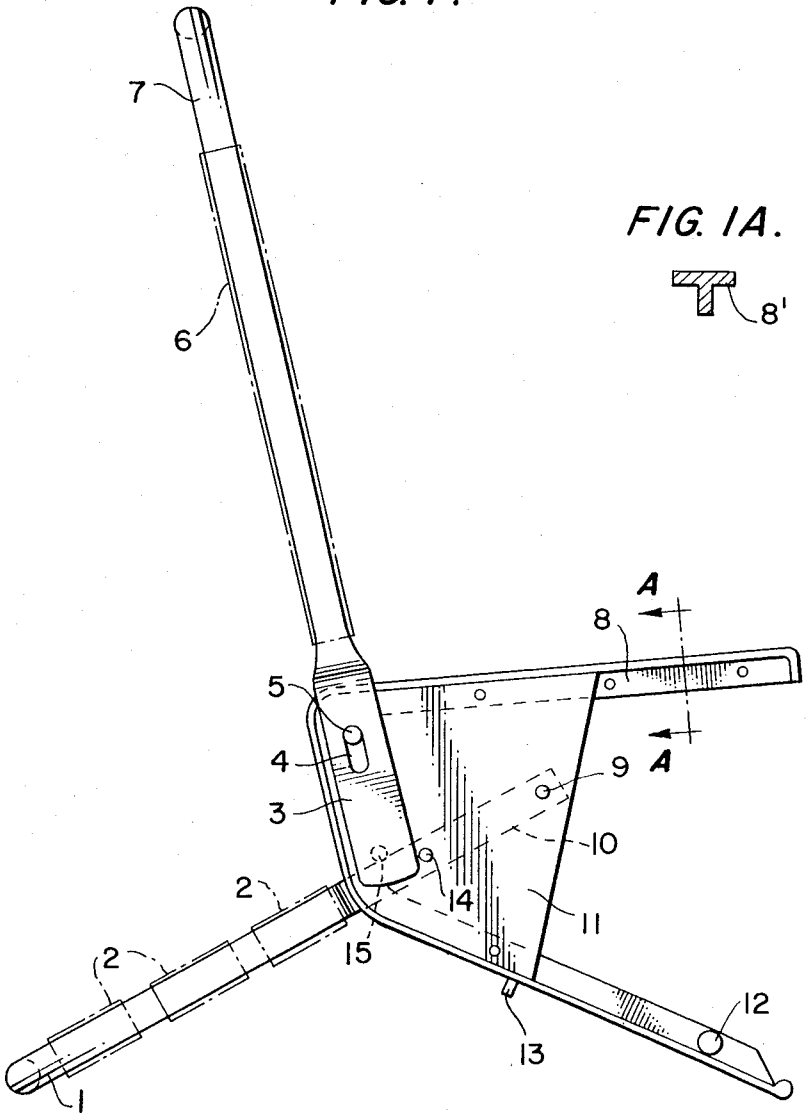
FIG. 2.

CHAIR CHANGEABLE INTO EASY CHAIR

BACKGROUND AND SUMMARY OF THE INVENTION

This invention relates to a chair that is convertible into an easy chair or lounge for one or more persons according to its width, and that basically includes three elements. One element is a main structure that forms a seat and one support when the apparatus is used as a chair and which forms supports when the apparatus is used as an easy chair. The other two elements are movable frames between lateral arms of which is suspended a rigid material or canvas or other similar flexible material in a continuous form or in strips, to support on the same a corresponding part of the human body. One frame is a backrest in either position of the apparatus. The other frame is a support when the apparatus is a chair and a seat when the apparatus is an easy chair.

The frames are pivotable about respective axes on the main structure. Catches are mounted on the main structure to limit rotation of the two frames about the respective axes thereof.

Transforming the chair into an easy chair is done by moving the support of the first element and rotating the frames. In this position, an accessory then may be added as a leg support.

BRIEF DESCRIPTION OF THE DRAWINGS

FIG. 1 is a side view of the chair/easy chair of the invention, with the device shown in the chair position.

FIG. 1A is a cross-section of the framework 8 taken along lines A—A of FIG. 1.

FIG. 2 is a rear view of the device seen in FIG. 1.

DETAILED DESCRIPTION OF THE INVENTION

Figures 3, 4:
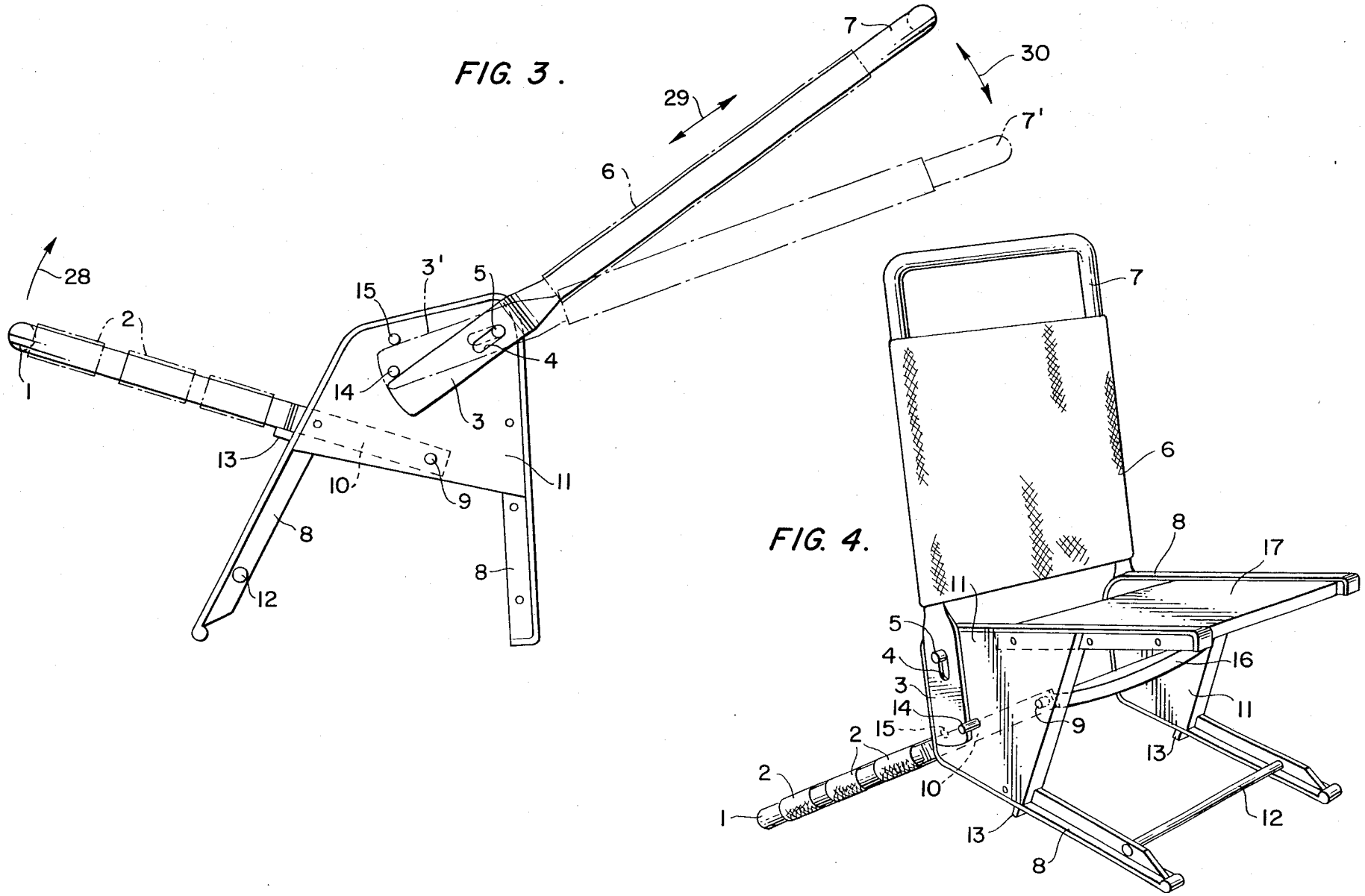
FIG. 3 is a side view of the device shown in the easy chair position.
FIG. 4 is a perspective view of the device, also shown in the chair position as in FIGS. 1 and 2.

With reference to the drawings, the parts and details of the chair convertible into an easy chair or lounge according to the invention are as follows.

The basic structure that forms the seat and two of the legs when the device is used as a chair includes two frameworks 8 each having a T-shaped section, as shown in FIG. 1A, and folded to form an open quadrilateral or a U-shaped member. Frameworks 8 are held in parallel planes by means of a small separating rod 12, a pair of rigid side panels 11 and rigid panel 17 that constitutes a seat when the device is used as a chair. Panel 17 is rigid to guarantee the rigidity of the framework structure.

Joined to this structure are two U-shaped frames 1 and 7 that can adopt various positions to complete the chair convertible into an easy chair.

Frame 1, as can be seen clearly in FIG. 2, terminates at the ends of the arms of the U in two inwardly spaced planar members 10 positioned inwardly of frameworks 8 and panels 11. Frame 1 rotates about an axis defined by pins 9 on the end of a tube 16, pins 9 being mounted in panels 11. Strips 2 of canvas or similar material are provided on frame 1 and serve as a seat support when the apparatus is used as an easy chair.

Figure 5:
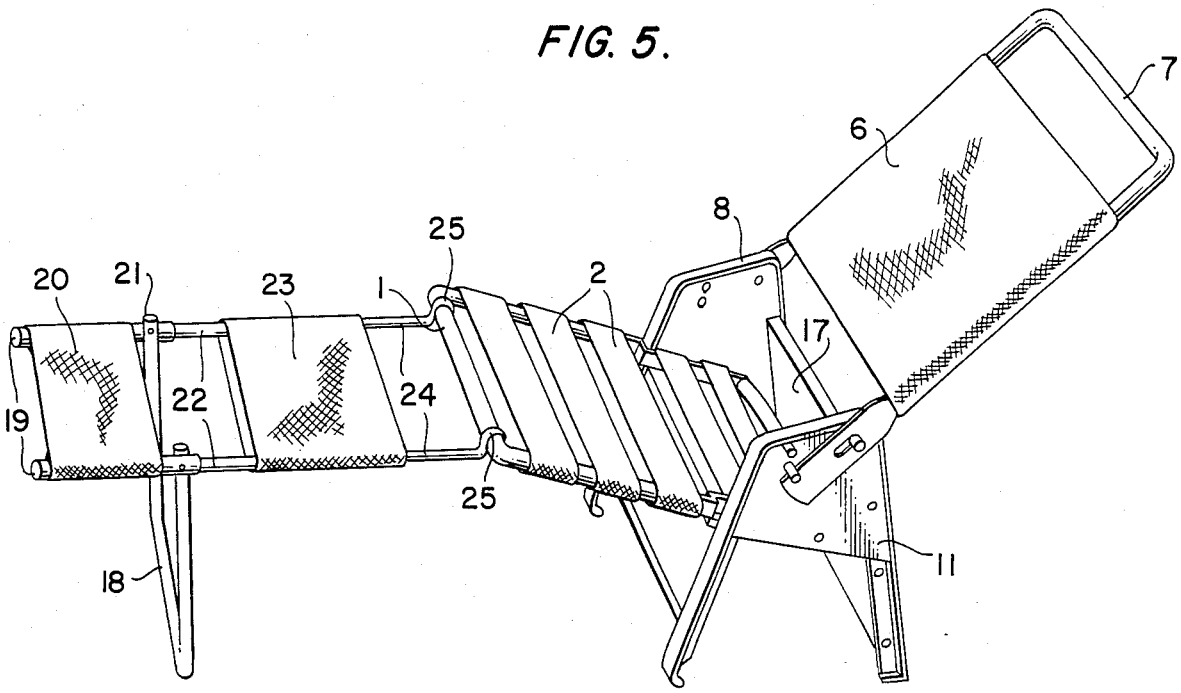
FIG. 5 is a perspective view of the device when it is used as an easy chair and has been fitted with an accessory leg rest.

The frame 7 forms a backrest and rotates on the exterior or interior of the lateral panels 11 around an axis defined by pins 5 mounted on panels 11. Pins 5 extend through elongated slots 4 formed in planar members 3 at the ends of the arms of the U of frame 7. Thus, the frame 7 is movable relative to pins 5 by an extent limited by slots 4. Catches or pins 14 on panels 11 serve to support the members 3 of the frame 7 and limit pivotal movement thereof in opposite directions when the apparatus is used as a chair (FIGS. 1, 2, 4) or as an easy chair (FIGS. 3, 5). Catches or pins 15 limit the rotation of frame 1 when the apparatus is used as a chair. Catches or pins 13 limit rotation of frame 1 when the apparatus is used as an easy chair. Frame 7 has a casing 6 of canvas or similar material. In FIG. 3, it can be seen that, when changing from the easy chair position to the chair position, the frame 7 rotates around the pins 5 in the direction indicated by arrows 30 and moves beyond the position 7', so that members 3 move beyond position 3' and can abut on the opposite side of pins 14, as shown in FIG. 1. This rotation of the frame 7 is effected after having been displaced outwardly in the direction shown by the arrows 29, thus moving members 3 to the opposite side of pins 14. Frame 1 rotates around pins 9 in the direction of arrow 28 into abutment with pins 15.

It is evident that the frames 1 and 7, with their respective flexible surfaces 2 and 6 that partially close them, can be replaced by rigid panels which would allow lowering the price of the product.

To complete the utility of the chair convertible into an easy chair, it has been devised so as to be dismantled easily and stored in the least volume possible. To do this, the screws or bolts that hold the ends of the bar 12, shown in FIG. 4, and those that hold the panel 17 are removed, the chair thus being dismantled and converted into elements of short height which when placed one atop the other occupy a very small space.

Now will be described a very useful accessory which may be used when the chair is converted into an easy chair in the position shown in FIGS. 3 and 5, and which consists of fitting to the same a support for the legs of the user.

This support includes two parallel sets of three telescopically extendible tubes 19, 22, 24 of successively smaller diameter, FIG. 5. At one end of each of the tubes 19 is pivotally mounted at 21 about an axis of rotation a support 18. Tubes 19 are wrapped by a single member 20 of canvas or similar material. A member 23 of canvas or similar material is wrapped around tubes 22, and also parts of tubes 24. Hooks 25 on outer ends of tubes 24 fit on the cross bar or base of frame 1, thus forming the leg support.

Figure 6:
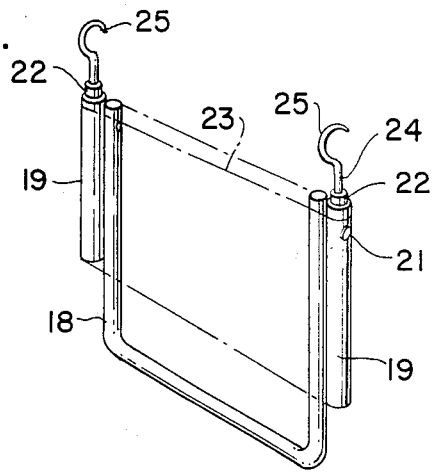
FIG. 6 is a perspective view of the accessory leg rest folded to occupy the least space possible.
Figure 8:
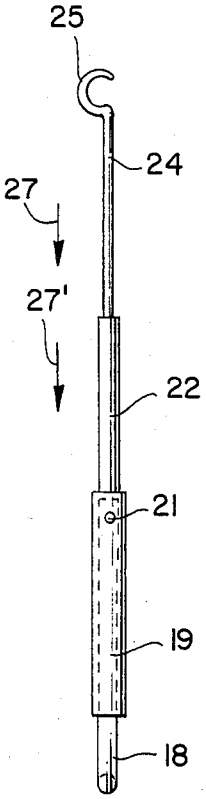
FIGS. 8 and 9 are side views respectively showing the accessory leg rest once the support has been folded and with the folding completed and the telescopic parts retracted.
Figure 9:
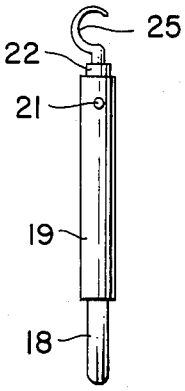
Figure 7:
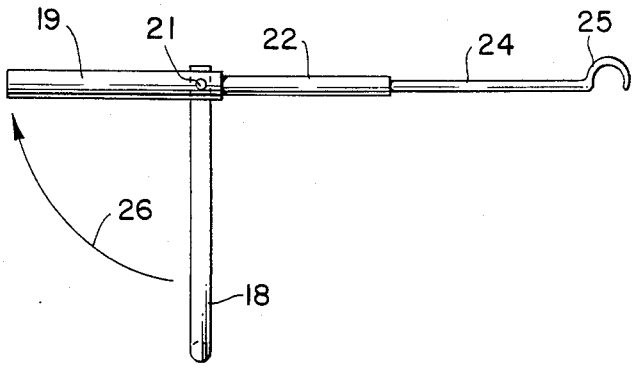
FIG. 7 is a side view of the metal structure of the accessory leg rest shown in FIGS. 5 and 6, but in a position of use.

To remove and store the support, the support 18 is moved in the direction of arrow 26 in FIG. 7, until the support 18 is positioned within and parallel to tubes 19. The support then is in the position shown in FIG. 8, at which time, as indicated by arrows 27 and 27', the tubes 24 are inserted into tubes 22 and tubes 22 are inserted into tubes 19, respectively. FIG. 9 shows this final condition, with the support canvases 20 and 23, which nonetheless are shown in FIG. 6, removed.

I claim:

1. An article of furniture which is convertible between first and second positions of use as a chair and as a lounge, respectively, said article of furniture comprising:

a base structure including two generally U-shaped frameworks each having first and second legs, said two frameworks being connected together in spaced parallel planes by a rod connecting said first legs and by a rigid panel extending between and connecting said second legs, said base structure being movable between said first position of use, whereat said rigid panel is a seat of said chair and said first legs form one support of said chair, and said second position of use, whereat said first and second legs form two supports of said lounge;

a first U-shaped frame having arms pivotally mounted to respective said frameworks about a first axis of rotation, said first frame being rotatable about said first axis between a first position, whereat said first frame forms another support of said chair when said base structure is in said first position of use, and a second position, whereat said first frame forms a seat of said lounge when said base structure is in said second position of use; and a second U-shaped frame having arms pivotally mounted to respective said frameworks about a second axis of rotation, said second frame being movable with respect to said second axis between a first position, whereat said second frame forms a backrest of said chair when said base structure is in said first position of use, and a second position, whereat said second frame forms a backrest of said lounge when said base structure is in said second position of use.

2. An article of furniture as claimed in claim 1, wherein each said framework is formed of a member having a generally T-shaped cross section.

3. An article of furniture as claimed in claim 1, wherein each said framework further includes a rigid panel extending between and fixed to said first and second legs.

4. An article of furniture as claimed in claim 1, further comprising means for limiting rotation of said first frame about said first axis at said first and second positions of said first frame.

5. An article of furniture as claimed in claim 4, wherein said limiting means comprises first stops on said frameworks to be abutted by said arms of said first frame when said first frame is in said first position thereof, and second stops on said frameworks to be abutted by said arms of said firt frame when said first frame is in said second position thereof.

6. An article of furniture as claimed in claim 1, further comprising means for limiting movement of said second frame with respect to said second axis at said first and second positions of said second frame.

7. An article of furniture as claimed in claim 6, wherein said limiting means comprises pins on said frameworks to be abutted by first sides of said arms of said second frame when said second frame is in said first position thereof and to be abutted by second sides of said arms of said second frame when said second frame is in said second position thereof, said arms of said second frame having therein elongated slots receiving respective said pins, such that said second frame is movable longitudinally with respect to said frameworks by a distance limited by the length of said slots.

8. An article of furniture as claimed in claim 1, further comprising an accessary leg support removably mounted on said first frame when said first frame is in said second position thereof, said leg support comprising two parallel sets of first, second and third telescopically extendible tubes of successively smaller diameter, a support pivotally connected to said first tubes, and hooks on said third tubes for fitting on said first frame.

* * * * *